US010342076B2

(12) United States Patent
Kawamata

(10) Patent No.: US 10,342,076 B2
(45) Date of Patent: Jul. 2, 2019

(54) ILLUMINATION SYSTEM AND CONTROLLER

(71) Applicant: Panasonic Intellectual Property Management Co., Ltd., Osaka (JP)

(72) Inventor: Mototsugu Kawamata, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/114,802

(22) Filed: Aug. 28, 2018

(65) Prior Publication Data

US 2019/0075626 A1 Mar. 7, 2019

(30) Foreign Application Priority Data

Sep. 1, 2017 (JP) ..... 2017-168325

(51) Int. Cl.
*H05B 33/08* (2006.01)
*H05B 37/02* (2006.01)
*F21V 23/00* (2015.01)

(52) U.S. Cl.
CPC ..... *H05B 33/08* (2013.01); *F21V 23/003* (2013.01); *H05B 37/0272* (2013.01)

(58) Field of Classification Search
None
See application file for complete search history.

(56) References Cited

U.S. PATENT DOCUMENTS

2012/0200232 A1* 8/2012 Erhardt ..... H05B 41/3921 315/219
2012/0306377 A1* 12/2012 Igaki ..... F21V 23/0464 315/151
2013/0320866 A1* 12/2013 Chung ..... H05N 33/0806 315/171
2015/0108901 A1* 4/2015 Greene ..... H05B 37/0218 315/149
2018/0315567 A1* 11/2018 Goettle ..... H05B 37/0227

FOREIGN PATENT DOCUMENTS

JP H07-106070 A 4/1995
JP H07-130474 A 5/1995
JP H10-125479 A 5/1998
JP 2000-012241 A 1/2000
JP 2001-338772 A 12/2001
JP 2002-246187 A 8/2002
JP 2002-260871 A 9/2002
JP 2002-260872 A 9/2002
JP 2008-204897 A 9/2008

* cited by examiner

*Primary Examiner* — Jany Richardson
(74) *Attorney, Agent, or Firm* — McDermott Will & Emery LLP

(57) ABSTRACT

An illumination system includes a luminaire, a controller, and a switch that turns ON and OFF power supply to the luminaire. The controller includes: a light intensity controller that performs light intensity control of controlling the brightness of the luminaire; and a power supply controller that instructs the switch to turn OFF the power supply to the luminaire on which the light intensity control is performed at a light intensity rate that is equal to or greater than 0 and at most a predetermined value.

10 Claims, 6 Drawing Sheets

FIG. 3

| POWER SUPPLY TERMINAL | SWITCH ADDRESS |
|---|---|
| 30a | 0ch-1 |
| 30b | 0ch-2 |
| 30c | 0ch-3 |
| 30d | 0ch-4 |

FIG. 4

| LUMINAIRE | LIGHT INTENSITY CONTROL ADDRESS | SWITCH ADDRESS |
|---|---|---|
| 20a | 1ch-1 | 0ch-1 |
| 20b | 1ch-1 | 0ch-1 |
| 20c | 1ch-1 | 0ch-1 |
| 20d | 1ch-1 | 0ch-1 |
| 20e | 1ch-2 | 0ch-2 |
| 20f | 1ch-2 | 0ch-2 |
| 20g | 1ch-2 | 0ch-2 |
| 20h | 1ch-2 | 0ch-2 |
| 20i | 1ch-3 | 0ch-3 |
| 20j | 1ch-3 | 0ch-3 |
| 20k | 1ch-3 | 0ch-3 |
| 20l | 1ch-3 | 0ch-3 |
| 20m | 1ch-4 | 0ch-4 |
| 20n | 1ch-4 | 0ch-4 |
| 20o | 1ch-4 | 0ch-4 |
| 20p | 1ch-4 | 0ch-4 |

FIG. 5

| BUTTON | LIGHT INTENSITY CONTROL RATIO | LIGHT INTENSITY CONTROL ADDRESS |
|---|---|---|
| 41a | 0% | 1ch-1 |
| 41b | 50% | 1ch-1 |
| 41c | 80% | 1ch-1 |
| 41d | 100% | 1ch-1 |

ILLUMINATION SYSTEM AND CONTROLLER

CROSS REFERENCE TO RELATED APPLICATION

This application claims the benefit of priority of Japanese Patent Application Number 2017-168325 filed on Sep. 1, 2017, the entire content of which is hereby incorporated by reference.

BACKGROUND

1. Technical Field

The present disclosure relates to an illumination system and a controller for controlling a luminaire.

2. Description of the Related Art

Conventionally, an illumination system including luminaires, a controller that performs light intensity control of controlling the brightness of the luminaires, and a switch (for example, a relay) that turns ON and OFF the power supply to the luminaires has been disclosed (for example, Japanese Unexamined Patent Application Publication No. H07-130474). Such an illumination system is applicable to large-scale buildings, for example, and is capable of performing the light intensity control on a large number of luminaires.

SUMMARY

With the above conventional illumination system, however, when the light intensity control is performed to cause the light intensity rate of the luminaires to be 0%, the luminaires are turned OFF but still continue to receive the power supply via the relay, resulting in generation of standby power consumed by the luminaires.

In view of the above, the present disclosure has an object to provide an illumination system and a controller capable of reducing power consumption.

An illumination system according to an aspect of the present disclosure is an illumination system including: a luminaire; a controller; and a switch that turns ON and OFF power supply to the luminaire. The controller includes: a light intensity controller that performs light intensity control of controlling a brightness of the luminaire; and a power supply controller that instructs the switch to turn OFF the power supply to the luminaire on which the light intensity control is performed at a light intensity rate of at least 0 and at most a predetermined value.

A controller according to an aspect of the present disclosure is a controller in an illumination system that includes a luminaire, the controller, and a switch that turns ON and OFF power supply to the luminaire. The controller includes: a light intensity controller that performs light intensity control of controlling the brightness of the luminaire; and a power supply controller that instructs the switch to turn OFF the power supply to the luminaire on which the light intensity control is performed at a light intensity rate of at least 0 and at most a predetermined value.

An illumination system according to an aspect of the present disclosure is an illumination system including: a luminaire; a controller; and a switch that turns ON and OFF power supply to the luminaire. The controller includes: a light intensity controller that performs light intensity control of controlling a brightness of the luminaire; and a power supply controller that instructs the switch to turn OFF the power supply to the luminaire on which the light intensity control is performed at a light intensity rate at which the luminaire is turned OFF.

An illumination system and a controller according to an aspect of the present disclosure are capable of reducing power consumption.

BRIEF DESCRIPTION OF DRAWINGS

The figures depict one or more implementations in accordance with the present teaching, by way of examples only, not by way of limitations. In the figures, like reference numerals refer to the same or similar elements.

FIG. 3 is a diagram illustrating an example of association between power supply terminals of a switch and switch addresses;

FIG. 4 is a diagram illustrating an example of association between luminaires and light intensity control addresses and association between the light intensity control addresses and switch addresses;

FIG. 5 is a diagram illustrating an example of association among buttons of a light intensity control switch, light intensity rates, and light intensity control addresses;

DETAILED DESCRIPTION OF THE EMBODIMENT(S)

Hereinafter, embodiments of the present disclosure are described in detail with reference to the drawings. Note that each of embodiments described below illustrates a specific example of the present disclosure. Therefore, the numerical values, structural elements, and the arrangement and connection of the structural elements, etc. shown in the embodiments below are mere examples, and are therefore not intended to limit the present disclosure. As such, among the structural elements in the embodiments below, structural elements not recited in any one of the independent claims defining the most generic concepts of the present disclosure are described as optional structural elements.

Note also that each figure is a schematic illustration and not necessarily a precise illustration. Furthermore, throughout the figures, the same structural elements share the same reference signs.

Embodiment 1

Hereinafter, Embodiment 1 is described with reference to FIG. 1 to FIG. 7.

[Configuration of Illumination System]

Figure 1:
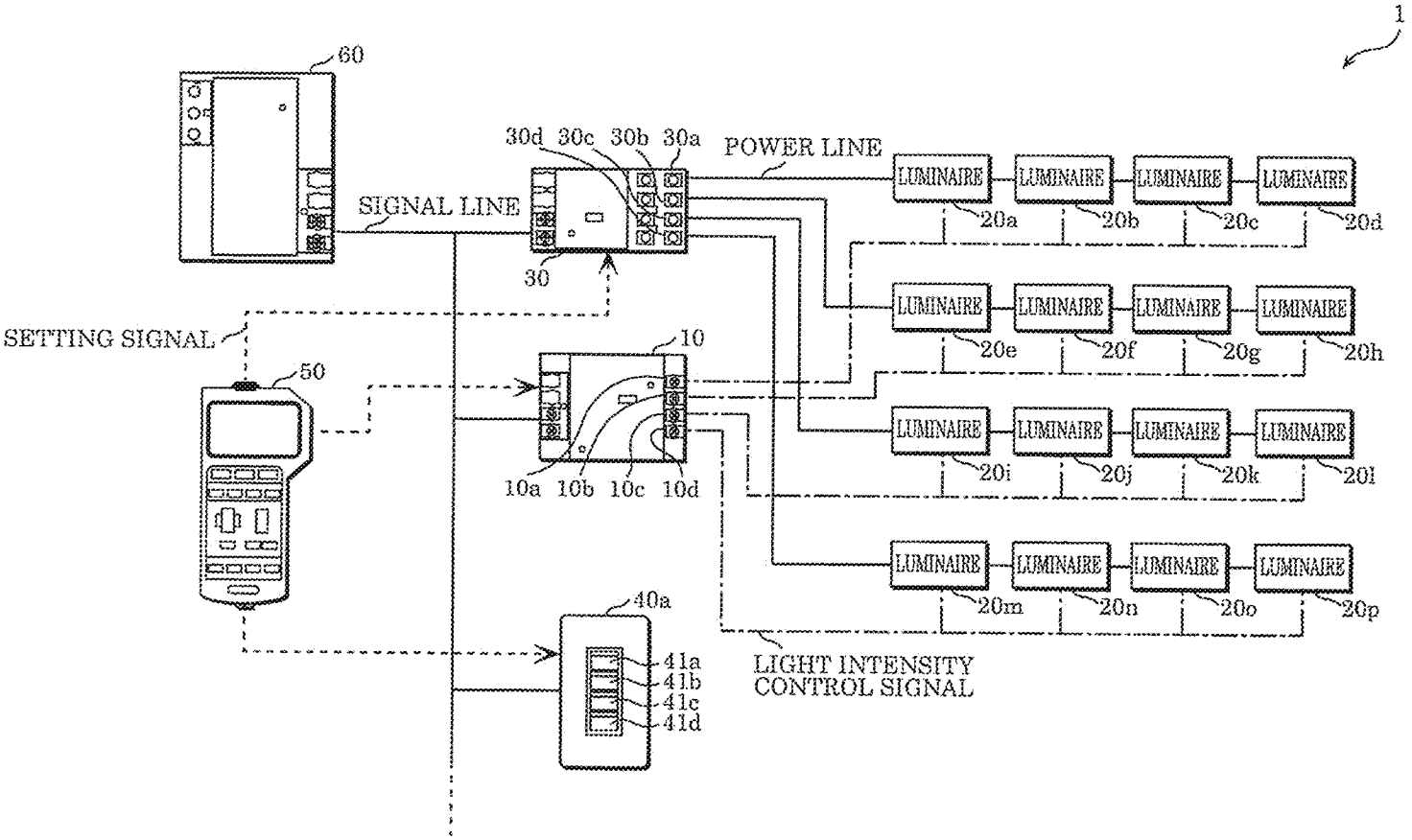
FIG. 1 is a configuration diagram illustrating an example of an illumination system according to Embodiment 1.

FIG. 1 is a configuration diagram illustrating an example of illumination system 1 according to Embodiment 1.

Illumination system 1 is a system for performing, for example, light intensity control of controlling the brightness of luminaires, and includes luminaires 20*a* to 20*p*, controller 10, and switch 30 that turns ON and OFF the power supply to luminaires 20*a* to 20*p*. Controller 10 is connected with luminaires 20*a* to 20*p* via wires, for example. Specifically, controller 10 includes controller terminals 10*a* to 10*d*, and luminaires 20*a* to 20*d* are connected to controller terminal 10*a*, luminaires 20*e* to 20*h* are connected to controller terminal 10*b*, luminaires 20*i* to 20*l* are connected to controller terminal 10*c*, and luminaires 20*m* to 20*p* are connected to controller terminal 10*d*. Illumination system 1 further includes: light intensity control switch 40*a* that controls light intensity rates of luminaires 20*a* to 20*p*; setting device 50 that makes a setting regarding control performed on luminaires 20*a* to 20*p*; and master device 60 that controls luminaires 20*a* to 20*p*. Note that the control performed on the luminaires refers to, for example, the light intensity control, color temperature control, and ON and OFF control performed on the luminaires.

Figure 2:
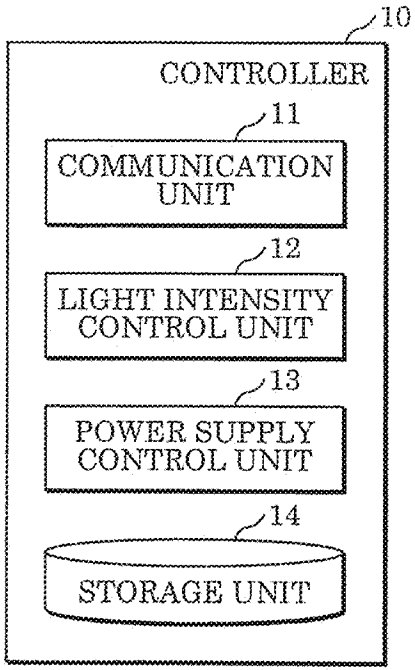
FIG. 2 is a configuration diagram illustrating an example of a controller according to Embodiment 1.

First, the following describes controller 10 with reference to FIG. 2. FIG. 2 is a configuration diagram illustrating an example of controller 10 according to Embodiment 1.

Controller 10 is a computer including a processor (microprocessor), a communication circuit, a power source circuit, etc., and includes communication unit (communicator) 11, light intensity control unit (light intensity controller) 12, power supply control unit (power supply controller) 13, and storage unit 14. Storage unit 14 is a read-only memory (ROM), a random-access memory (RAM), etc., and may include a nonvolatile memory, for example. Communication unit 11 is realized by a communication circuit. The communication circuit includes, for example: a transmission and reception circuit that transmits and receives a control signal to and from master device 60; a transmission and reception circuit that transmits and receives a light intensity control signal to and from luminaires 20*a* to 20*p*; and a wireless circuit that transmits and receives a wireless signal to and from setting device 50. The processor performs processing to control communication unit 11, light intensity control unit 12, power supply control unit 13, etc., by executing a program stored in storage unit 14.

Communication unit 11 receives an instruction (a control signal) from master device 60, and transmits to luminaires 20*a* to 20*p* a signal for controlling luminaires 20*a* to 20*p*, according to the instruction. Further, communication unit 11 receives a signal (a setting signal) from setting device 50, and information included in the setting signal is stored in storage unit 14.

Light intensity control unit 12 performs light intensity control on luminaires 20*a* to 20*p*. For example, when communication unit 11 receives, from master device 60, a control signal indicating that the light intensity rate of one or more desired luminaire(s) to be changed, light intensity control unit 12 performs the light intensity control on the desired luminaire(s) by causing communication unit 11 to transmit a light intensity control signal for changing the light intensity rate to the desired luminaire(s).

Power supply control unit 13 instructs switch 30 to turn OFF the power supply to one or more luminaires on which the light intensity control is performed at a light intensity rate of at least 0 and at most a predetermined value. This instruction is given via master device 60, for example. For example, controller 10 once transmits the instruction to master device 60, and master device 60 transmits the instruction to switch 30. With this, the power supply to the luminaire(s) on which the light intensity control has been performed at the light intensity rate of at least 0 and at most the predetermined value is turned OFF, thereby making it possible to reduce generation of standby power consumed by the luminaire(s). Note that the light intensity rate of at least 0 and at most the predetermined value is a light intensity rate at which the luminaire(s) is (are) turned OFF, and the predetermined value is, but not particularly limited to, between 1% to 10% of the maximum intensity, or at most 5%, for example. Further, the light intensity rate at which the luminaire(s) is (are) turned OFF may be, for example, a light intensity rate at which the luminaire(s) cannot stably emit light or a light intensity rate equivalent to a level of illuminance invisible by humans.

Further, when the light intensity control is to be performed at a light intensity rate higher than the predetermined value on the luminaire(s) for which the power supply is currently OFF, power supply control unit 13 instructs switch 30 to turn ON the power supply to said luminaire(s). This instruction is also given via master device 60, for example. With this, when the luminaire(s) for which the power supply has been turned OFF is (are) to be turned ON at the light intensity rate higher than the predetermined value, the power supply to said luminaire(s) can resume.

Luminaires 20*a* to 20*p* are devices each of which includes a light source, can be turned ON and OFF, and can change the light intensity rate (brightness). Luminaires 20*a* to 20*p* are supplied with electric power via switch 30. Since illumination system 1 is applicable to a large-scale building, a plurality of luminaires are installed in the building. In the present embodiment, luminaires 20*a* to 20*p* are an example of such luminaires.

Switch 30 is, for example, a relay that turns ON and OFF the power supply to luminaires 20*a* to 20*p*. Switch 30 includes power supply terminals 30*a* to 30*d*. Luminaires 20*a* to 20*d* are connected to power supply terminal 30*a*, luminaires 20*e* to 20*h* are connected to power supply terminal 30*b*, luminaires 20*i* to 20*l* are connected to power supply terminal 30*c*, and luminaires 20*m* to 20*p* are connected to power supply terminal 30*d*. For example, when receiving from master device 60 an instruction to turn OFF the power supply to luminaires 20*a* to 20*d*, switch 30 turns OFF the power supply to luminaires 20*a* to 20*d* by turning OFF the power supply from power supply terminal 30*a*.

Light intensity control switch 40*a* is a switch for giving luminaires 20*a* to 20*p* an instruction on the light intensity rate of luminaires 20*a* to 20*p*, and is, for example, a wall switch provided on a wall of the building to which illumination system 1 is applied. For example, light intensity control switch 40*a* has four buttons 41*a* to 41*d* as illustrated in FIG. 1. Each button is associated with a light intensity control address of luminaires 20*a* to 20*d*, for example. This allows light intensity control switch 40*a* to give luminaires 20*a* to 20*d* an instruction on the light intensity rate of luminaires 20*a* to 20*d*. Further, each button is associated with a desired light intensity rate. For example, each button has two states, namely, ON state and OFF state, and has a function to cause controller 10 to perform the light intensity control on a plurality of luminaires at the desired light intensity rate in the case of the ON state.

For example, button 41*a* is associated with a light intensity rate of 0%, button 41*b* is associated with a light intensity rate of 50%, button 41*c* is associated with a light intensity rate of 80%, and button 41*d* is associated with a light intensity rate of 100%. For example, when button 41*a* is put into the ON state, the light intensity control is performed on luminaires 20*a* to 20*d* at the light intensity rate of 0%. Specifically, when button 41*a* is put into the ON state, light intensity control switch 40*a* transmits, to master device 60, a signal indicating that the light intensity rate of luminaires

20*a* to 20*d* is to be 0%. Then, master device 60 transmits the signal to controller 10, and controller 10 performs the light intensity control to cause the light intensity rate of luminaires 20*a* to 20*d* to be 0%.

Setting device 50 generates setting information regarding control performed on luminaires 20*a* to 20*p*, and transmits the setting information to controller 10, switch 30, light intensity control switch 40*a*, etc.

The setting information transmitted to switch 30 includes, for example, information for associating power supply terminals 30*a* to 30*d* of switch 30 with switch addresses. FIG. 3 is a diagram illustrating an example of the association between power supply terminals 30*a* to 30*d* of switch 30 and switch addresses. As illustrated in FIG. 3, according to the setting information transmitted to switch 30, power supply terminal 30*a* is associated with switch address 0ch-1, power supply terminal 30*b* is associated with switch address 0ch-2, power supply terminal 30*c* is associated with 0ch-3, and power supply terminal 30*d* is associated with switch address 0ch-4. Note that the association between the power supply terminals and the switch addresses is stored in, for example, a storage unit included in switch 30.

The setting information transmitted to controller 10 includes, for example, information for associating luminaires 20*a* to 20*p* with light intensity control addresses and for associating the light intensity control addresses with the switch addresses of the power supply terminals. The light intensity control addresses are addresses for performing the light intensity control on luminaires 20*a* to 20*p*, and controller 10 performs the light intensity control on the luminaire(s) associated with a designated light intensity control address. FIG. 4 is a diagram illustrating an example of the association between luminaires 20*a* to 20*p* and the light intensity control addresses and the association between the light intensity control addresses and the switch addresses.

As illustrated in FIG. 4, according to the setting information transmitted to controller 10, luminaires 20*a* to 20*d* are associated with light intensity control address 1ch-1, luminaires 20*e* to 20*h* are associated with light intensity control address 1ch-2, luminaires 20*i* to 20*l* are associated with light intensity control address 1ch-3, and luminaires 20*m* to 20*p* are associated with light intensity control address 1ch-4. Note that since luminaires 20*a* to 20*d* are connected to controller terminal 10*a*, association of controller terminal 10*a* with light intensity control address 1ch-1 leads to association of luminaires 20*a* to 20*d* with light intensity control address 1ch-1, for example. Likewise, association of controller terminal 10*b* with light intensity control address 1ch-2 leads to association of luminaires 20*e* to 20*h* with light intensity control address 1ch-2, association of controller terminal 10*c* with light intensity control address 1ch-3 leads to association of luminaires 20*i* to 20*l* with light intensity control address 1ch-3, and association of controller terminal 10*d* with light intensity control address 1ch-4 leads to association of luminaires 20*m* to 20*p* with light intensity control address 1ch-4. Note that the association between luminaires 20*a* to 20*p* and the light intensity control addresses is stored in, for example, storage unit 14 included in controller 10.

Furthermore, as illustrated in FIG. 4, according to the setting information transmitted to controller 10, light intensity control address 1ch-1 is associated with switch address 0ch-1, light intensity control address 1ch-2 is associated with switch address 0ch-2, light intensity control address 1ch-3 is associated with switch address 0ch-3, and light intensity control address 1ch-4 is associated with switch address 0ch-4. Note that the association between the light intensity control addresses and the switch addresses is stored in, for example, storage unit 14 included in controller 10.

The setting information transmitted to light intensity control switch 40*a* includes, for example, information for associating the buttons of light intensity control switch 40*a*, the light intensity rates, and the light intensity control addresses. FIG. 5 is a diagram illustrating an example of the association among the buttons of light intensity control switch 40*a*, the light intensity rates, and the light intensity control addresses.

As illustrated in FIG. 5, according to the setting information transmitted to light intensity control switch 40*a*, button 41*a* is associated with the light intensity rate of 0% and light intensity control address 1ch-1, button 41*b* is associated with the light intensity rate of 50% and light intensity control address 1ch-1, button 41*c* is associated with the light intensity rate of 80% and light intensity control address 1ch-1, and button 41*d* is associated with the light intensity rate of 100% and light intensity control address 1ch-1. Note that the association among the buttons, the light intensity rates, and the light intensity control addresses is stored in, for example, a storage unit included in light intensity control switch 40*a*. In the present embodiment, light intensity control switch 40*a* is presented as a switch for light intensity control address 1ch-1 (that is, a switch for luminaires 20*a* to 20*d*).

Master device 60 is a master controller that operates as a central element of illumination system 1.

Here, the following describes an operation performed by illumination system 1 when the light intensity control is to be performed on luminaires 20*a* to 20*d* at the light intensity rate of at least 0 and at most the predetermined value.

First, button 41*a* of light intensity control switch 40*a* is put into the ON state. With this, light intensity control switch 40*a* transmits, to master device 60, information indicating that the light intensity rate of luminaires 20*a* to 20*d* associated with light intensity control address 1ch-1 is to be 0%. Master device 60 transmits the information to controller 10. Based on the information, controller 10 causes the light intensity rate of luminaires 20*a* to 20*d* associated with light intensity control address 1ch-1 to be 0%. Specifically, controller 10 causes the light intensity rate of luminaires 20*a* to 20*d* connected to controller terminal 10*a* associated with light intensity control address 1ch-1 to be 0%.

Next, controller 10 instructs switch 30 to turn OFF the power supply to luminaires 20*a* to 20*d* on which the light intensity control has been performed at the light intensity rate of 0%. Specifically, controller 10 transmits, to master device 60, information indicating that the power supply from power supply terminal 30*a* associated with switch address 0ch-1 associated with light intensity control address 1ch-1 is to be turned OFF. Master device 60 transmits the information to switch 30. Based on the information, switch 30 turns OFF the power supply from power supply terminal 30*a* associated with switch address 0ch-1 to luminaires 20*a* to 20*d* connected to power supply terminal 30*a*.

Next, the following describes an operation performed by illumination system 1 when the light intensity control is to be performed at the light intensity rate higher than the predetermined value on luminaires 20*a* to 20*d* for which the power supply is currently OFF.

First, button 41*c* of light intensity control switch 40*a* is put into the ON state. With this, light intensity control switch 40*a* transmits, to master device 60, information indicating that the light intensity rate of luminaires 20*a* to 20*d* associated with light intensity control address 1ch-1 is to be 80%, which is higher than the predetermined value. Master device 60 transmits the information to controller 10.

Based on the information, controller 10 attempts to cause the light intensity rate of luminaires 20*a* to 20*d* associated with light intensity control address 1ch-1 to be 80%. However, since the power supply to luminaires 20*a* to 20*d* is currently OFF, controller 10 instructs switch 30 to turn ON the power supply to luminaires 20*a* to 20*d*. Specifically, controller 10 transmits, to master device 60, information indicating that the power supply from power supply terminal 30*a* associated with switch address 0ch-1 associated with light intensity control address 1ch-1 is to be turned ON. Master device 60 transmits the information to switch 30. Based on the information, switch 30 turns ON the power supply from power supply terminal 30*a* associated with switch address 0ch-1 to luminaires 20*a* to 20*d* connected to power supply terminal 30*a*. Then, controller 10 causes the light intensity rate of luminaires 20*a* to 20*d* associated with light intensity control address 1ch-1 to be 80%.

Although the configuration of illumination system 1 has been described above, the configuration of illumination system 1 is not limited to the one illustrated in FIG. 1.

Figure 6:
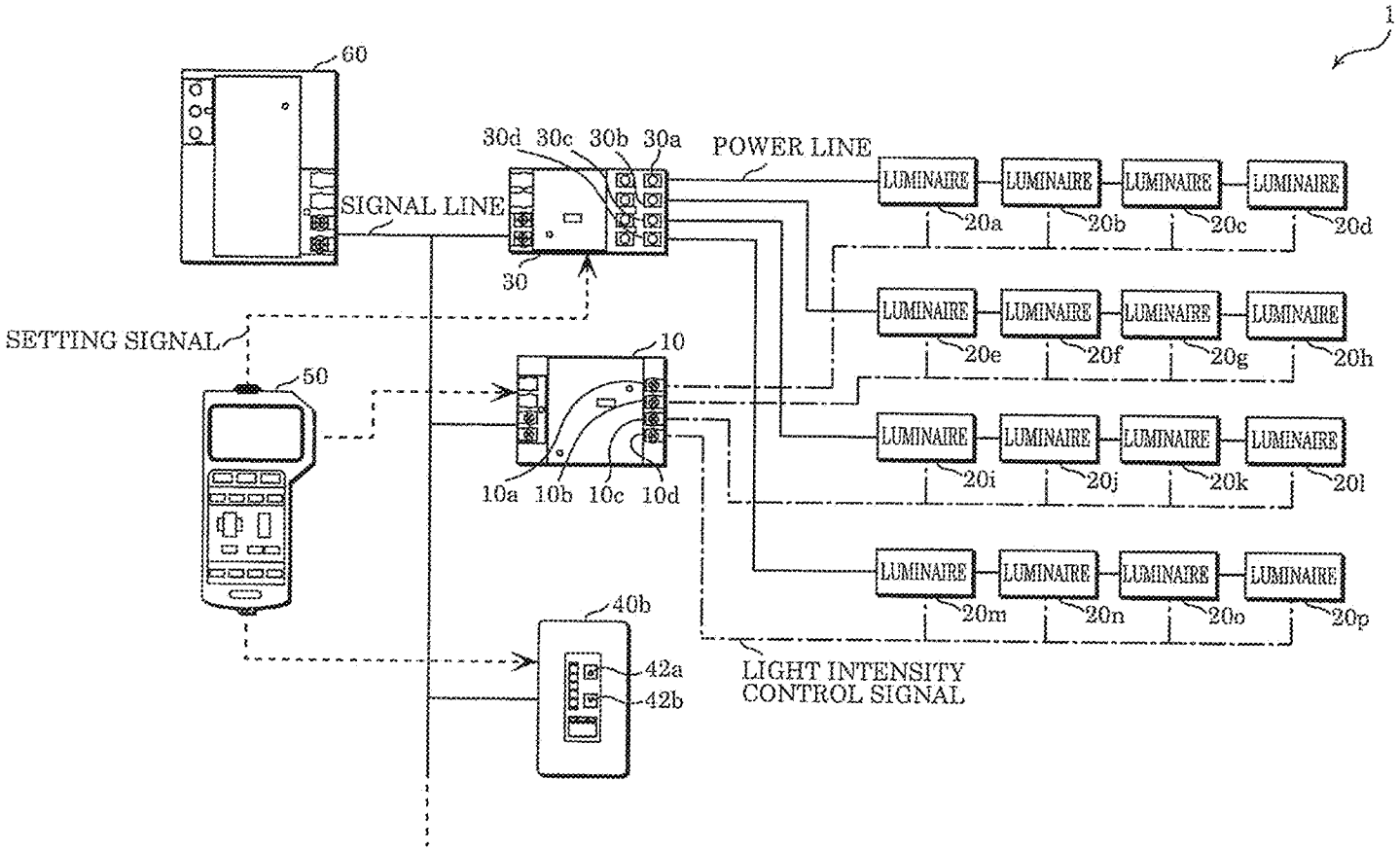
FIG. 6 is a configuration diagram illustrating another example of the illumination system according to Embodiment 1.
Figure 7:
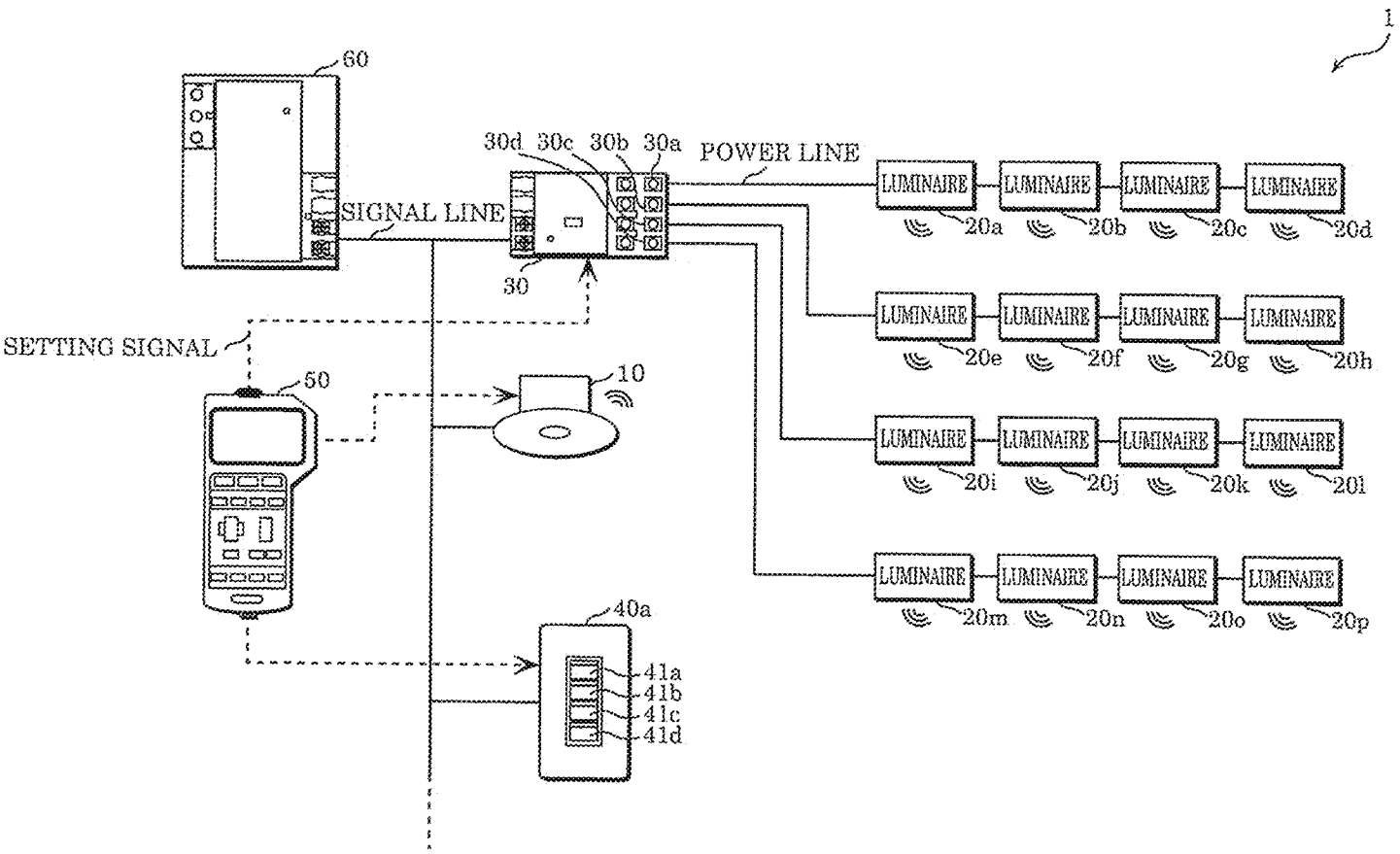
FIG. 7 is a configuration diagram illustrating another example of the illumination system according to Embodiment 1.

FIG. 6 and FIG. 7 are configuration diagrams each illustrating another example of illumination system 1 according to Embodiment 1.

As illustrated in FIG. 6, illumination system 1 may include light intensity control switch 40*b*.

Light intensity control switch 40*b* is a switch for giving luminaires 20*a* to 20*p* an instruction to continuously change the light intensity rate, and is, for example, a wall switch provided on a wall of the building to which illumination system 1 is applied. For example, light intensity control switch 40*b* has two buttons 42*a* and 42*b* as illustrated in FIG. 6. Each button is associated with the address of luminaires 20*a* to 20*d*, for example. This allows light intensity control switch 40*b* to give luminaires 20*a* to 20*d* an instruction on the light intensity rate.

For example, when button 42*a* is held down, the light intensity control is performed on luminaires 20*a* to 20*d* to increase the light intensity rate. Specifically, when button 42*a* is held down, light intensity control switch 40*b* transmits, to master device 60, a signal indicating that the light intensity rate of luminaires 20*a* to 20*d* is to be increased. Then, master device 60 transmits the signal to controller 10, and controller 10 performs the light intensity control to increase the light intensity rate of luminaires 20*a* to 20*d*. Further, for example, when button 42*b* is held down, the light intensity control is performed on luminaires 20*a* to 20*d* to decrease the light intensity rate. Specifically, when button 42*b* is held down, light intensity control switch 40*b* transmits, to master device 60, a signal indicating that the light intensity rate of luminaires 20*a* to 20*d* is to be decreased. Then, master device 60 transmits the signal to controller 10, and controller 10 performs the light intensity control to decrease the light intensity rate of luminaires 20*a* to 20*d*.

For example, when button 42*b* is held down, the light intensity control is performed on luminaires 20*a* to 20*d* at the light intensity rate of at least 0 and at most the predetermined value. Further, when button 42*a* is pressed after this light intensity control is performed, the light intensity control is performed at the light intensity rate higher than the predetermined value on luminaires 20*a* to 20*d* for which the power supply is currently OFF.

Furthermore, as illustrated in FIG. 7, controller 10 and the luminaires may be wirelessly connected. That is to say, light intensity control unit 12 may give the luminaires an instruction on the light intensity control, via wireless communication. In this case, controller 10 and the luminaires are paired in advance by, for example, storing each other's media access control (MAC) address etc. This makes it possible to associate the luminaires paired with controller 10, with light intensity control addresses.

Advantageous Effects, Etc

As described above, illumination system 1 according to the present embodiment includes: luminaires 20*a* to 20*p*; controller 10; and switch 30 that turns ON and OFF power supply to luminaires 20*a* to 20*p*. Controller 10 includes: light intensity control unit 12 configured to perform light intensity control of controlling the brightness of luminaires 20*a* to 20*p*; and power supply control unit 13 configured to instruct switch 30 to turn OFF the power supply to one or more luminaires on which the light intensity control is performed at a light intensity rate of at least 0 and at most a predetermined value.

With this, it is possible to turn OFF the power supply to the luminaire(s) on which the light intensity control has been performed at the light intensity rate of at least 0 and at most the predetermined value, that is, the luminaire(s) which is (are) in the OFF state or in substantially the OFF state. Note that the light intensity rate of at most the predetermined value is a light intensity rate close to 0. This reduces the occurrence of a situation where the power continues to be supplied via switch 30 even though the luminaire(s) has (have) been turned OFF. As a result, it is possible to reduce generation of standby power consumed by the luminaire(s), thus enabling reduction of power consumption.

Further, when the light intensity control is performed at a light intensity rate higher than the predetermined value on the luminaire(s) for which the power supply is currently OFF, power supply control unit 13 may be configured to instruct switch 30 to turn ON the power supply to the luminaire(s).

With this, it is possible to turn ON again the luminaire(s) for which the power supply has been turned OFF.

Further, light intensity control unit 12 may be configured to give luminaires 20*a* to 20*p* an instruction on the light intensity control, via wireless communication.

With this, when, for example, illumination system 1 includes a plurality of controllers 10, it is possible to increase the flexibility in the pairing between controllers 10 and luminaires 20*a* to 20*p*.

Further, controller 10 according to the present embodiment is a controller in illumination system 1 that includes luminaires 20*a* to 20*p*, controller 10, and switch 30 that turns ON and OFF power supply to luminaires 20*a* to 20*p*. Controller 10 includes: light intensity control unit 12 configured to perform light intensity control of controlling the brightness of luminaires 20*a* to 20*p*; and power supply control unit 13 configured to instruct switch 30 to turn OFF the power supply to one or more luminaires on which the light intensity control is performed at a light intensity rate of at least 0 and at most a predetermined value.

With this, it is possible to provide controller 10 capable of reducing the power consumption.

Further, illumination system 1 according to the present embodiment includes: luminaire 20*a* to 20*p*; controller 10; and switch 30 that turns ON and OFF power supply to luminaires 20*a* to 20*p*. Controller 10 includes: light intensity control unit 12 configured to perform light intensity control of controlling the brightness of luminaires 20*a* to 20*p*; and power supply control unit 13 configured to instruct switch 30 to turn OFF the power supply to one or more luminaires on which the light intensity control is performed at a light intensity rate at which the luminaire(s) is (are) turned OFF.

With this, it is possible to turn OFF the power supply to the luminaire(s) which is (are) in the OFF state. This reduces the occurrence of a situation where the power continues to be supplied via switch 30 even though the luminaire(s) has (have) been turned OFF. As a result, it is possible to reduce generation of standby power consumed by the luminaire(s), thus enabling reduction of power consumption.

Embodiment 2

Next, Embodiment 2 is described with reference to FIG. 8.

Figure 8:
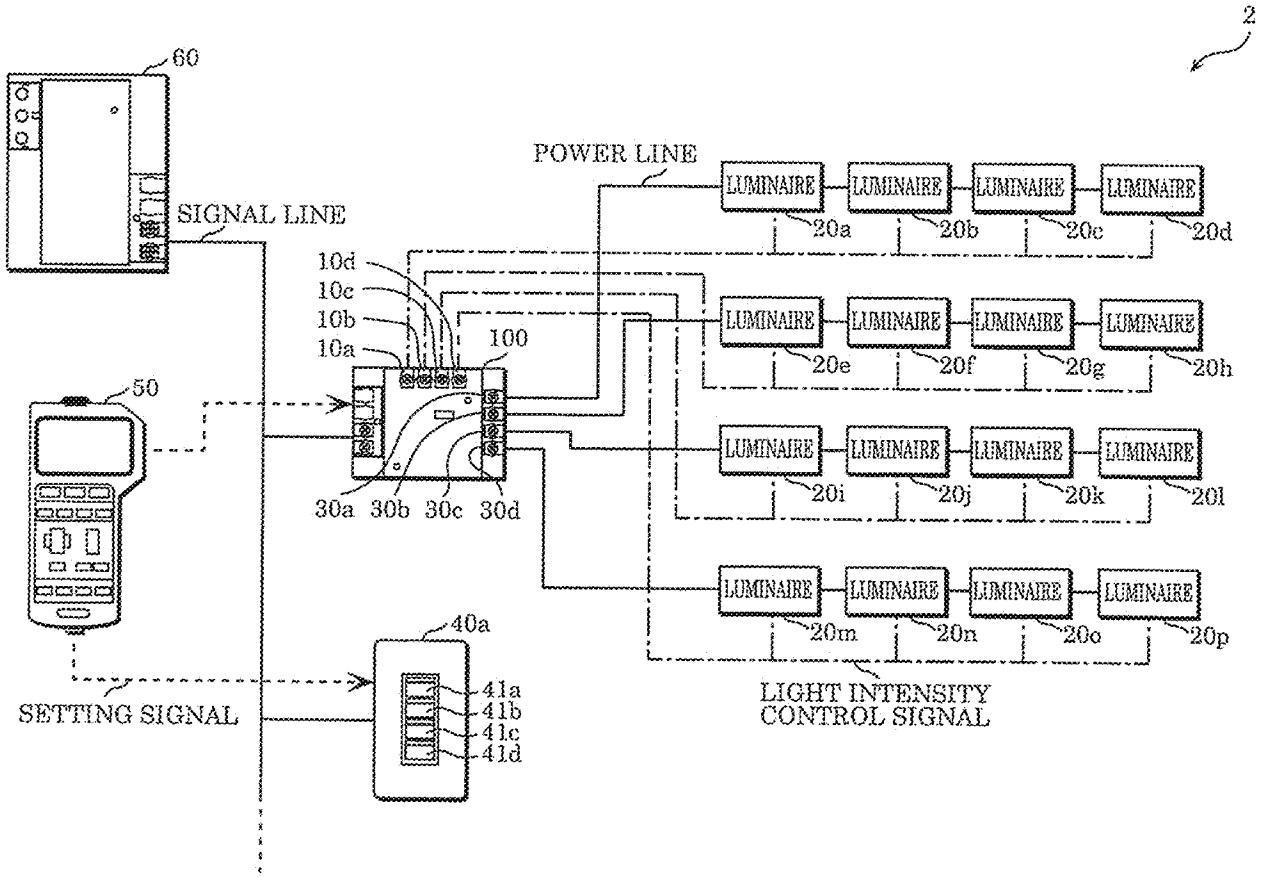
FIG. 8 is a configuration diagram illustrating an example of an illumination system according to Embodiment 2.

FIG. 8 is a configuration diagram illustrating an example of illumination system 2 according to Embodiment 2. The configuration of illumination system 2 according to Embodiment 2 is different from that of illumination system 1 according to Embodiment 1 in that controller 10 and switch 30 according to Embodiment 1 are integrally formed. The other aspects of the configuration are the same as those in Embodiment 1, and are therefore not described again. Hereinafter, a description is given with focus on the points of difference from Embodiment 1.

Controller 100 is a controller in which controller 10 and switch 30 according to Embodiment 1 are integrally formed. Controller 100 therefore includes both controller terminals 10*a* to 10*d* and power supply terminals 30*a* to 30*d*. Controller 100 further includes a switch circuit (for example, a relay drive circuit) in addition to a processor (a microprocessor), a communication circuit, a power source circuit, etc.

Here, the following describes an operation performed by illumination system 2 when the light intensity control is to be performed on luminaires 20*a* to 20*d* at a light intensity rate of at least 0 and at most a predetermined value.

First, button 41*a* of light intensity control switch 40*a* is put into the ON state. With this, light intensity control switch 40*a* transmits, to master device 60, information indicating that the light intensity rate of luminaires 20*a* to 20*d* associated with light intensity control address 1ch-1 is to be 0%. Master device 60 transmits the information to controller 100. Based on the information, controller 100 causes the light intensity rate of luminaires 20*a* to 20*d* associated with light intensity control address 1ch-1 to be 0%. Specifically, controller 100 causes the light intensity rate of luminaires 20*a* to 20*d* connected to controller terminal 10*a* associated with light intensity control address 1ch-1 to be 0%. Then, controller 100 instructs switch 30, which is included in controller 100 itself, to turn OFF the power supply to luminaires 20*a* to 20*d* on which the light intensity control has been performed at the light intensity rate of 0%, and turns OFF the power supply from power supply terminal 30*a* associated with switch address 0ch-1 to luminaires 20*a* to 20*d* connected to power supply terminal 30*a*.

Next, the following describes an operation performed by illumination system 2 when the light intensity control is to be performed on luminaires 20*a* to 20*d* for which the power supply is currently OFF at a light intensity rate higher than the predetermined value.

First, button 41*c* of light intensity control switch 40*a* is put into the ON state. With this, light intensity control switch 40*a* transmits, to master device 60, information indicating that the light intensity rate of luminaires 20*a* to 20*d* associated with light intensity control address 1ch-1 is to be 80%, which is higher than the predetermined value. Master device 60 transmits the information to controller 100.

Based on the information, controller 100 attempts to cause the light intensity rate of luminaires 20*a* to 20*d* associated with light intensity control address 1ch-1 to be 80%. However, since the power supply to luminaires 20*a* to 20*d* is currently OFF, controller 100 instructs switch 30, which is included in controller 100 itself, to turn ON the power supply to luminaires 20*a* to 20*d*.

Specifically, controller 100 turns ON the power supply from power supply terminal 30*a* associated with switch address 0ch-1 associated with light intensity control address 1ch-1 to luminaires 20*a* to 20*d* connected to power supply terminal 30*a*. Then, controller 100 causes the light intensity rate of luminaires 20*a* to 20*d* associated with light intensity control address 1ch-1 to be 80%.

As described above, controller 10 and switch 30 may be integrally formed.

With this, the light intensity control on luminaires 20*a* to 20*p* and the turning ON and OFF of the power supply can be performed by a device into which controller 10 and switch 30 are integrally formed, thereby enabling the light intensity control on luminaires 20*a* to 20*p* and the turning ON and OFF of the power supply to be easily performed in conjunction with each other.

Other Embodiments

Although the illumination system and the controller according to Embodiments 1 and 2 have been described above, the present disclosure is not limited to the above embodiments.

For example, although the illumination system includes light intensity control switch 40*a*, light intensity control switch 40*b*, setting device 50, master device 60, etc., illumination system need not include these.

Further, for example, although switch 30 in the above embodiments is a mechanical switch such as a relay, switch 30 may be a semiconductor switch etc. In this case, for example, if there are no power supply terminals, the switch addresses may be associated with individual semiconductor switches etc.

Furthermore, the present disclosure can be realized not only as an illumination system and a controller, but also as a method including steps (processing) performed by each structural element of the illumination system and the controller.

For example, these steps may be executed by a computer (a computer system). The present disclosure can be realized as a program that causes the computer to execute the steps included in the method. The present disclosure can be also realized as a non-transitory computer-readable recording medium, such as a compact disc-read-only memory (CD-ROM), having the program recorded thereon.

For example, when the present disclosure is realized as a program (software), each step is executed by the program being executed using hardware resources such as a CPU, memory, and an input/output circuit of a computer. In other words, each step is executed by the CPU performing computation on data obtained from, for example, the memory or the input/output circuit and outputting the result of the computation to, for example, the memory or the input/output circuit.

The structural elements included in the illumination system and the controller according to the above embodiments may be realized as a specialized circuit or a general purpose circuit.

Further, the structural elements included in the illumination system and the controller according to the above embodiments may be realized as large scale integration (LSI) that is an integrated circuit (IC).

The integrated circuit is not limited to LSI, and a specialized circuit or a general purpose processor may be used. It is also possible to use a field programmable gate array (FPGA) that is programmable or a reconfigurable processor that allows reconfiguration of the connection and settings of circuit cells inside LSI.

Further, if a technology for implementing an integrated circuit that supersedes LSI is introduced as a result of development in the semiconductor technology or another derivative technology, the structural elements included in the illumination system and the controller may surely be realized as integrated circuits using that technology.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. An illumination system, comprising:
a luminaire;
a controller; and
a switch that turns ON and OFF power supply to the luminaire, wherein
the controller includes:
a light intensity controller that performs light intensity control of controlling a brightness of the luminaire; and
a power supply controller that instructs the switch to turn OFF the power supply to the luminaire on which the light intensity control is performed at a light intensity rate that is equal to or greater than 0 and at most a predetermined value, wherein:
the switch is a relay including a power supply terminal to which the luminaire is connected,
the power supply terminal is associated with a switch address,
the luminaire is associated with a light intensity control address,
the switch address and the light intensity control address are associated with each other, and
when instructed by the power supply controller to turn OFF the power supply to the luminaire on which the light intensity control is performed at the light intensity rate that is equal to or greater than 0 and at most the predetermined value, the switch turns OFF the power supply from the power supply terminal associated with the switch address that is associated with the light intensity control address associated with the luminaire.

2. The illumination system according to claim 1, wherein
when the light intensity control is performed at a light intensity rate higher than the predetermined value on the luminaire for which the power supply is currently OFF, the power supply controller instructs the switch to turn ON the power supply to the luminaire.

3. The illumination system according to claim 1, wherein
the light intensity controller gives the luminaire an instruction on the light intensity control, via wireless communication.

4. The illumination system according to claim 1, wherein
the controller and the switch are integrally formed.

5. The illumination system according to claim 1, wherein
the switch is separately provided from the controller.

6. The illumination system according to claim 1, wherein
the predetermined value is at most 5% of a maximum intensity of the luminaire.

7. The illumination system according to claim 1, wherein
the switch is a semiconductor switch.

8. The illumination system according to claim 1, further comprising:
a master device that controls the luminaire, wherein
the light intensity controller performs the light intensity control of controlling the brightness of the luminaire when receiving, from the master device, a control signal indicating that a light intensity rate of the luminaire is to be changed.

9. A controller in an illumination system that includes a luminaire, the controller, and a switch that turns ON and OFF power supply to the luminaire, the controller comprising:
a light intensity controller that performs light intensity control of controlling a brightness of the luminaire; and
a power supply controller, wherein:
the switch is a relay including a power supply terminal to which the luminaire is connected,
the power supply terminal is associated with a switch address,
the luminaire is associated with a light intensity control address,
the switch address and the light intensity control address are associated with each other, and
the power supply controller instructs the switch to turn OFF the power supply to the luminaire on which the light intensity control is performed at a light intensity rate that is equal to or greater than 0 and at most a predetermined value from the power supply terminal associated with the switch address that is associated with the light intensity control address associated with the luminaire.

10. An illumination system, comprising:
a luminaire;
a controller; and
a switch that turns ON and OFF power supply to the luminaire, wherein
the controller includes:
a light intensity controller that performs light intensity control of controlling a brightness of the luminaire; and
a power supply controller that instructs the switch to turn OFF the power supply to the luminaire on which the light intensity control is performed at a light intensity rate at which the luminaire is turned OFF, wherein:
the switch is a relay including a power supply terminal to which the luminaire is connected,
the power supply terminal is associated with a switch address,
the luminaire is associated with a light intensity control address,
the switch address and the light intensity control address are associated with each other, and
when instructed by the power supply controller to turn OFF the power supply to the luminaire on which the light intensity control is performed at the light intensity rate at which the luminaire is turned OFF, the switch turns OFF the power supply from the power supply terminal associated with the switch address that is associated with the light intensity control address associated with the luminaire.

* * * * *